United States Patent [19]

Okamura et al.

[11] 4,031,337

[45] June 21, 1977

[54] LOUDSPEAKER

[75] Inventors: Yasushi Okamura; Kiichiro Tanaka; Takashi Takeda, all of Fukuoka, Japan

[73] Assignee: Matsushita Electric Industrial Co., Ltd., Japan

[22] Filed: Dec. 3, 1975

[21] Appl. No.: 637,282

[30] Foreign Application Priority Data

Dec. 16, 1974 Japan ..... 49-152999
Dec. 16, 1974 Japan ..... 49-153001

[52] U.S. Cl. ..... 179/115.5 H; 181/159
[51] Int. Cl.² ..... H04R 9/00; G10K 13/00
[58] Field of Search ..... 181/159, 158; 179/115.5 PC, 115.5 H, 115.5 ES, 179

[56] References Cited

UNITED STATES PATENTS

| | | | |
|---|---|---|---|
| 2,194,070 | 3/1940 | Giannini | 181/159 |
| 2,490,227 | 12/1949 | Murkham | 179/115.5 PC |
| 2,858,377 | 10/1958 | Levy | 181/159 |
| 2,957,054 | 10/1960 | Levy et al. | 181/159 |
| 3,792,526 | 2/1974 | Bremseth | 179/115.5 PC |

*Primary Examiner*—Stephen J. Tomsky
*Attorney, Agent, or Firm*—Burgess Ryan and Wayne

[57] ABSTRACT

A loudspeaker consisting of a driver or motor unit consisting of a cylindrical magnet structure, a voice coil and a domed diaphragm; an enclosure unit for receiving therein the driver or motor unit; and a horn unit attached mechanically to the opened end of the enclosure unit, the positioning or locating cylindrical section of the horn unit being snugly fitted into the enclosure unit. The assembly is much facilitated, and the driver or motor unit, the enclosure unit and the horn unit may be located and held in correctly mutually coaxially aligned relationship in a very simple manner. In one embodiment, a spring is loaded between the driver or motor unit and the enclosure unit so that the domed diaphragm may be restrained under the forces in excess of 1.5 kg/cm² over which the lowest resonance frequency may be stabilized.

5 Claims, 6 Drawing Figures

LOUDSPEAKER

BACKGROUND OF THE INVENTION

The present invention relates to generally an improvement of the construction of a loudspeaker and more particularly to a loudspeaker wherein a driver or motor unit including a domed diaphragm, an enclosure unit and a horn unit are located and held in correctly mutually coaxially aligned relationship (to be referred to as "in aligned position" hereinafter in this specification for brevity), and the assembly of the horn unit with the enclosure unit may be accomplished in a simple yet very reliable manner.

When the horn, the diaphram, voice coil and magnet structure of a loudspeaker are not mutually coaxially aligned to each other; that is, when the magnetic gap is not uniform, the characteristics of the loudspeaker are considerably degraded. In the assembly of the prior art loudspeakers, the components thereof are correctly located with respect to each other by means of jigs, and assembled together with screws or bolts and nuts in such a way that the peripheral edge of the domed diaphragm may be suitably restrained. Therefore, the force restraining the peripheral edge of the domed diaphragm varies from one loudspeaker to another so that the lowest resonant frequent of the loudspeaker assembled is not satisfactorily stabilized. Furthermore, the prior art loudspeakers require a relatively large number of assembly steps. In the prior art loudspeakers, the lead wire is generally attached to the edge of the diaphragm while the terminal plate is attached to the frame of the loudspeaker with rivets or eyelets. As a result, the number of assembly steps is further increased with the result of the increase in cost, and the disconnection of the lead wire tends to occur very frequently.

SUMMARY OF THE INVENTION

One of the objects of the present invention is therefore to provide a loudspeaker wherein its component parts such as a magnet structure, diaphragm, voice coil, horn, enclosure unit and so on may be located and held in correctly mutually coaxially aligned relationship.

Another object of the present invention is to provide a loudspeaker wherein its horn and enclosure units are securely assembled with each other in a simple manner.

A further object of the present invention is to provide a loudspeaker wherein a spring is provided in order to impart the constant restraining force to the peripheral edge of the domed diaphragm, whereby the stability of the lowest resonant frequency may be ensured.

A further object of the present invention is to provide a loudspeaker wherein the connection between the voice coil and the terminal plate through the lead wire may be facilitated in assembly and the disconnection of the lead wire may be prevented.

To the above and other ends, the present invention provides a loudspeaker wherein a driver or motor unit consisting of a magnet structure, a voice coil and a domed diaphram is received in a cylindrical section of an enclosure unit, and a horn unit is mechanically attached to the opened end of the enclosure unit, whereby the driver or motor unit, the enclosure unit and the horn unit may be located and held in correctly mutually coaxially aligned relationship when assemblied.

BRIEF DESCRIPTION OF THE DRAWING

Same reference numerals are used to designate similar parts throughout the figures.

Figure 1:
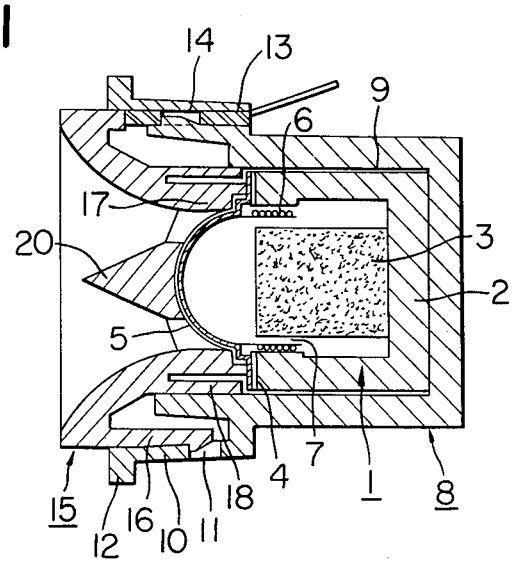
FIG. 1 is a sectional view of a first embodiment of a loudspeaker in accordance with the present invention.
Figure 2:
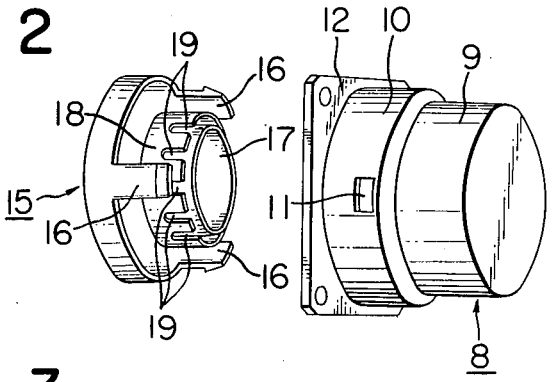
FIG. 2 is an exploded, perspective view of an enclosure unit and a horn unit thereof.

DESCRIPTION OF THE PREFERRED EMBODIMENTS:

First Embodiment, FIGS. 1 and 2

In FIGS. 1 and 2, there is shown the first embodiment of a loudspeaker in accordance with the present invention comprising, in general, a driver or motor unit, an enclosure unit 8 and a horn unit 15. The driver or motor unit consists of a magnetic structure 1 comprising a cylindrical yoke 2 and a cylindrical center magnetic piece 3 located coaxially of the yoke 2; a domed diaphragm 5 whose peripheral edge is attached through a mounting ring 4 to the opened end of the yoke 2; and a voice coil 6 located in a magnetic gap 7 defined by the magnetic structure 1 and operatively coupled to the domed diaphragm 5.

The enclosure unit 8 for enclosing therein the driver or motor unit is made of synthetic resin or nonmagnetic metal plate, and consists of a cup-shaped, small-diameter sylindrical section 9, a large-diameter cylindrical section 10 formed integral with and coaxially of the small-diameter cylindrical section 9, and a substantially square mounting flange 12 extended outwardly from the opened end of the large-diameter cylindrical section 10. The inner diameter and depth of the cylindrical hollow cavity of the small-diameter section 9 are so selected that the driver or motor unit may be snugly fitted and received in the cylindrical cavity of the small-diameter cylindrical section 9. As best shown in FIG. 2, the large-diameter section 10 is provided with a plurality of rectangular engaging slots 11 formed through the side wall thereof and equiangularly circumferentially spaced apart from each other. The large-diameter section 10 is further provided with a terminal hole 14 formed through the side wall thereof in parallel with the axis of the enclosure unit 8 for receiving therein a terminal 13 which in turn is electrically connected through a lead wire (not shown) to the voice coil 6. The mounting flange 12 is provided with bolt or screw holes formed through thereof at the corners thereof.

The horn unit 15 is made of synthetic resin, and has a plurality of engaging projections 16 formed integral therewith and extended backwardly (that is, toward the enclosure unit 8) in parallel with the axis of the horn unit 15 and equiangularly spaced apart from each other. The free end of each engaging projection 16 terminates into a pawl as best shown in FIG. 1 which is adapted to engage with the engaging slot 11 of the large-diameter section 10 when the projection 16 is inserted into an engaging hole formed in the side wall of the large-diameter section 10 and communicated with the engaging slot 11 (See FIG. 1). The horn unit 15 further includes a positioning or locating cylindrical section 18 formed integral with and coaxially and backwardly thereof and spaced apart from a throat 17 of the horn unit 15 by a suitable distance. The positioning section 18 is provided with a plurality of axial notches 19 equiangularly spaced apart from each other, and has an outer diameter slightly smaller than the inner diameter of the cylindrical cavity of the small-diameter section 9 so that the positioning section 18 may be fitted therein. The horn unit further includes an equalizer 20 extended forwardly from the throat 17.

Next the mode of assembly of the driver or motor unit, the enclosure unit 8 and the horn unit 15 with the above construction will be described. In the first step the driver or motor unit consisting of the magnetic structure 1 and the domed diaphragm 6 is fitted into the cylindrical cavity of the smaller-diameter section 9 of the enclosure unit 8 from the open end thereof. Thereafter, the horn unit 15 is attached to the enclosure unit 8 with the positioning section 18 fitted into the extension of the cylindrical cavity of the small-diameter section 9 and the pawl-shaped ends of the engaging projections 16 engaged with the engaging slots 11 of the large-diameter section 10. Thus the loudspeaker is completely assembled.

Since the peripheral edge of the throat 17 of the horn unit 15 presses the peripheral edge of the domed diaphragm 5 against the mounting ring 4 on the magnetic structure 1, the domed diaphragm 5 may be securely retained in position. Since the sylindrical yoke 2 of the driver or motor unit is fitted into the cylindrical cavity of the small-diameter section 9 of the enclosure unit 8, the driver or motor unit may be easily aligned with the enclosure unit 8. Since the horn unit 15 has the positioning section 18 which is fitted into the cylindrical cavity of the small-diameter section 9 of the enclosure unit 8, the horn unit 15 may be also easily aligned with the enclosure unit 8 and the driver or motor unit when assembled. Since the positioning section 18 is provided with a plurality of notches 19, it may be resiliently pressed against the inner wall of the cylindrical cavity of the small-diameter section 9 so that the horn unit 15 may be securely aligned with the enclosure unit 8 and hence the driver or motor unit.

Figure 3:
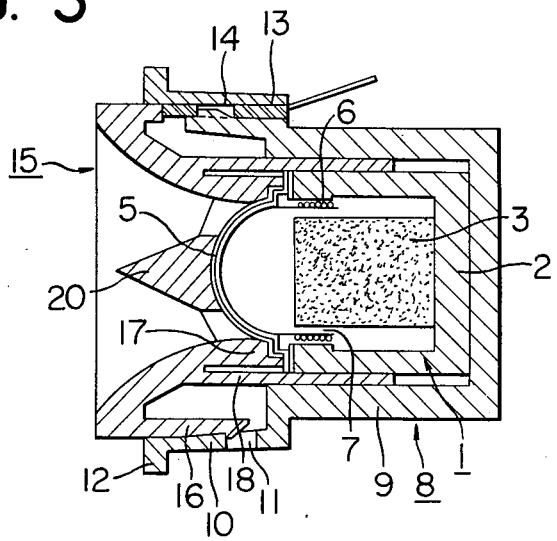
FIG. 3 is a sectional view of a second embodiment of the present invention.
Figure 4:
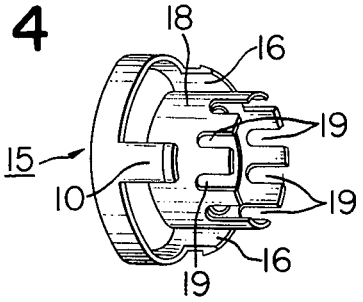
FIG. 4 is a perspective view of a horn unit thereof.

Second Embodiment, FIGS. 3 and 4

The second embodiment shown in FIGS. 3 and 4 is substantially similar in construction to the first embodiment described above and shown in FIGS. 1 and 2 except that the driver or motor unit is held in position in the enclosure unit 8 by the positioning or locating cylindrical section 18 of the horn unit 15. That is, the positioning section 18, which is made longer as compared with the first embodiment, is interposed between the inner wall of the cylindrical cavity of the small-diameter section 9 of the enclosure unit 8 and the side wall of the cylindrical yoke 2 of the magnet structure 1 of the driver or motor unit as best shown in FIG. 3. Therefore, the outer diameter of the positioning section 18 of the horn unit 15 is slightly smaller than the inner diameter of the cylindrical cavity of the small-diameter section 9 of the enclosure unit 8 while the inner diameter of the positioning section 18 is slightly larger than the outer diameter of the driver or motor unit and hence the cylindrical yoke 2.

In assembly, first the driver or motor unit is fitted into the positioning section 18 of the horn unit 15, and thereafter the enclosure unit 8 is fitted to the horn unit 15. That is, the positioning section 18 is fitted into the cylindrical cavity of the small-diameter section 9 of the enclosure unit 8 with the pawl-shaped ends of the engaging projections 16 engaged with the engaging slots 11 of the large-diameter section 10 of the enclosure-unit 8 as with the case of the first embodiment. Thus the loudspeaker is completely assemblied with the three units correctly aligned.

The cylindrical cavity of the small-diameter section 9 of the enclosure unit 8 serves to securely hold the driver or motor unit in correctly coaxially aligned relation with the enclosure unit in the first embodiment while in the second embodiment, the positioning section 18 of the horn unit 15 serves to hold the driver or motor unit in correctly aligned relationship with the enclosure unit 8. And the positioning section 18 of the horn unit 15 serves to locate and hold the horn unit 15 in correctly aligned relationship with the enclosure unit 8. Thus, the driver or motor unit, the enclosure unit 8 and the horn unit 15 may be correctly aligned with each other so that the characteristics of the loudspeaker may be remarkably stabilized. Since the positioning section 18 is provided with a plurality of notches 19, it may be resiliently pressed against the inner wall of the cylindrical cavity of the small-diameter section 9, the more secure and stable coupling between the horn unit 15 and the enclosure unit 8 may be ensured in addition to the coupling provided by the engagement between the engaging projections 16 and the engaging slots 11.

In assembly, the three units are sequentially assembled without the use of the adhesive or screws so that the assembly step may be much facilitated, resulting in the considerable reduction in cost.

Figure 5:
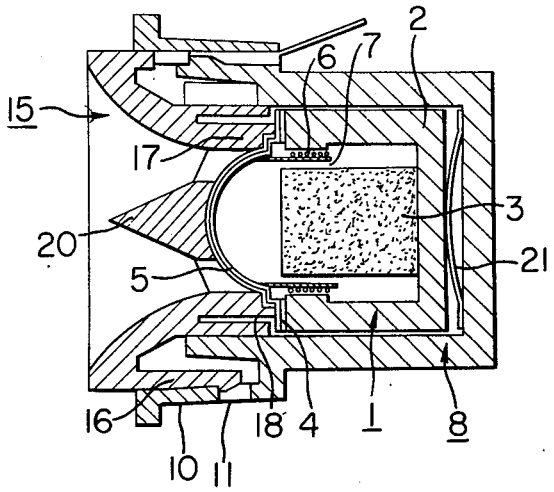
FIG. 5 is a sectional view of a third embodiment of the present invention.

Third Embodiment, FIG. 5

The third embodiment shown in FIG. 5 is substantially similar in construction to the first embodiment described above with reference to FIGS. 1 and 2 except that a leaf spring 21 is placed between the bottom of the cylindrical cavity of the small-diameter section 9 of the enclosure unit 8 and the bottom of the cylindrical yoke 2 of the magnet structure 1 of the driver or motor unit. The spring 21 serves to press the magnet structure 1 against the throat 17 of the horn unit 15 so that the domed diaphragm 5 may be more securely retained in position.

In general, the lowest resonant frequency may be stabilized when the peripheral edge of the domed diaphragm 5 is retained stationary under the force of more than 1.5 kg/cm$^2$. Therefore the leaf spring 21 having strong force must be selected. For instance, when the peripheral edge with the width of one milimeter of the domed diaphragm with the diameter of 15 mm is retained in place and when the leaf spring 21 is capable of imparting to the cylindrical yoke 2 a force of the order of 4 kg, then the peripheral edge of the domed diaphragm 5 is retained in place under the force of 7.96 kg/cm$^2$ so that the lowest resonance frequency may be considerably stabilized. The third embodiment has a distinct advantage over the first and second embodiments in that the domed diaphram 5 may be restrained under the constant force of the leaf spring 21 regardless of the dimensional errors of the parts and positional errors among the three units, produced in assembly.

Figure 6:
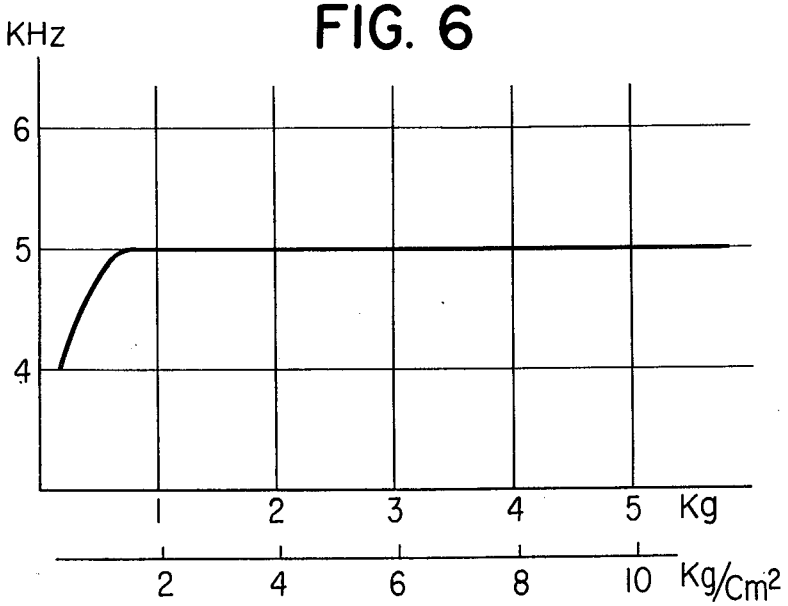
FIG. 6 is a graph used for the explanation of the relationship between the lowest resonat frequency and the magnitude of the force with which the peripheral edge of the domed diaphragm of the speaker is restrained.

FIG. 6 shows the relation between the lowest resonant frequency to in KHz plotted along the ordinate and the force in Kg imparted by the spring 21, that is, the restraining force in Kg/cm² acting upon the peripheral edge with the with of one millimeter of the domed diaphragm with the diameter of 15 mm. It is seen that the lowest resonant frequency may be very satisfactorily stabilized when the restraining force is in excess of 1.5 kg/cm². Therefore, when the leaf spring capable of imparting the sufficiently great force, for instance 4 kg, to the cylindrical yoke 2 is loaded as described above so as to produce the restraining force in excess of 1.5 kg/cm², the lowest resonant frequency may be satisfactorily stabilized even if there arise the positional errors in assembly and some dimensional errors in the component parts.

As described above, according to the third embodiment of the present invention, the dimensional errors of the component parts may be satisfactorily compensated by the provision of the spring between the cylindriccal yoke 2 and the small-diameter section 9, and the domed diaphragm 6 may be retained in place under the force of higher than 1.5 kg/cm² so that the stability of the lowest resonant frequency may be ensured. Furthermore the assembly step may be much facilitated, and the high quality and stabilized characteristics of the assembled loudspeakers may be ensured.

It is to be understood that the spring 21 may be also used in the second embodiment and a cone type diaphragm or a flat type diaphragm may also be used, in the place of the domed diaphragm, to function in the same manner to have advantages similar to that of the domed diaphragm does.

What is claimed is:

1. A loudspeaker comprising:

a cup-shaped enclosure unit having a closed end and a cylindrical side wall, a portion of said side wall remote from said end having a plurality of circumferential slots therein;

a magnetic structure disposed in said enclosure unit and secured thereto, said structure comprising magnetic material and have (i) an annular end surface and (ii) a cylindrical air gap coaxial with the side wall of said enclosure unit;

a flexible diaphragm having a circular outer ring adjacent the annular end surface of said magnetic structure;

a voice coil secured to said diaphragm and disposed within said air gap;

a horn unit having an outer cylindrical portion, a cylindrical alignment portion, and an inner cylindrical diaphragm retaining portion;

said outer portion of said horn unit having a corresponding plurality of flexible pawl parts in interlocking engagement with the slots of said enclosure unit;

the alignment portion of said horn unit having an outer diameter slightly less than the inner diameter of the wall portion of said enclosure unit, said alignment portion being disposed adjacent said wall portion;

the inner portion of said horn unit having an annular end part adjacent the circular outer ring of said diaphragm, so that said diaphragm is retained in position with the circular outer ring thereof disposed between the annular end surface of said magnetic structure and the annular end part of said inner portion of said horn unit.

2. The loudspeaker according to claim 1, wherein said alignment portion of said horn unit includes a plurality of longitudinal notches therein.

3. The loudspeaker according to claim 1, wherein the alignment portion of said horn unit is disposed between the side wall of said enclosure unit and said magnetic structure.

4. The loudspeaker according to claim 1, further comprising spring means disposed between said end of said enclosure unit and said magnetic structure for urging together said i. annular end surface of said magnetic structure, ii. circular outer ring of said diaphragm, and iii. annular end part of said inner portion of said horn unit.

5. The loudspeaker according to claim 4, wherein the pressure applied to said end surface, outer ring and end part by said spring means is at least 1.5 kg./cm².

* * * * *

UNITED STATES PATENT OFFICE

CERTIFICATE OF CORRECTION

Patent No. 4,031,337 Dated June 21, 1977

Inventor(s) Yasusi Okamura, et al

It is certified that error appears in the above-identified patent and that said Letters Patent are hereby corrected as shown below:

Column 1, line 67: "assemblied" should be --assembled--.

Column 2, line 13: "resonat" should be --resonant--.

Column 5, line 35: "diaphragm does." should be --diaphragm.--

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*